US005492357A

United States Patent [19]

Fagot

[11] Patent Number: 5,492,357

[45] Date of Patent: Feb. 20, 1996

[54] SKI WITH LONGITUDINAL REINFORCEMENT

[75] Inventor: Jacques Fagot, Saint Jean de Moirans, France

[73] Assignee: Skis Rossignol SA, France

[21] Appl. No.: 346,090

[22] Filed: Nov. 29, 1994

[30] Foreign Application Priority Data

Nov. 30, 1993 [FR] France ..... 93 14562

[51] Int. Cl.[6] ..... A63C 5/12

[52] U.S. Cl. ..... 280/602; 280/610

[58] Field of Search ..... 280/602, 610

[56] References Cited

U.S. PATENT DOCUMENTS

| | | | |
|---|---|---|---|
| 2,581,532 | 1/1952 | Hem | 280/610 |
| 3,722,901 | 3/1973 | Koike | 280/610 |
| 3,823,956 | 7/1974 | Zechmeister et al. | 280/610 |
| 5,005,853 | 4/1991 | Lampl | 280/610 |
| 5,108,124 | 4/1992 | Pascal et al. | 280/609 |
| 5,169,170 | 12/1992 | Hayashi | 280/610 |

FOREIGN PATENT DOCUMENTS

| | | | |
|---|---|---|---|
| 0284878 | 3/1988 | European Pat. Off. . | |
| 1290278 | 3/1962 | France | 280/610 |
| 1435153 | 3/1966 | France | 280/610 |
| 87478 | 8/1966 | France | 280/610 |
| 2589745 | 5/1987 | France . | |
| 2590179 | 5/1987 | France . | |
| 2611517 | 9/1988 | France . | |
| 2687924 | 9/1993 | France . | |
| 49-49574 | 12/1974 | Japan | 280/610 |
| 92588 | 8/1958 | Sweden | 280/610 |
| 152918 | 6/1932 | Switzerland | 280/610 |

*Primary Examiner*—Brian L. Johnson
*Attorney, Agent, or Firm*—Harris Beach & Wilcox

[57] ABSTRACT

A ski comprising: a first, lower assembly (10), including a planar running sole (11) having a plane of symmetry (P) perpendicular to the plane of the running sole and passing through the longitudinal mid-axis of the running sole; a second, upper assembly (15), forming a top (16) and lateral sides (17); and these two assemblies define an intermediate space (20), in which the neutral fiber (FN) is located, wherein the inclined longitudinal reinforcement element consists of a flat strip (25) which, while defining an acute angle with respect to the plane of the running sole (11), is arranged asymmetrical with respect to the plane (P) of symmetry of the lower assembly (10).

3 Claims, 4 Drawing Sheets

SKI WITH LONGITUDINAL REINFORCEMENT

BACKGROUND OF THE INVENTION

1. Technical Field

The invention relates to an improved ski, especially a ski having asymmetric structure.

2. Prior Art

As is known, in cross section, a ski may comprise three essential parts, namely, in order:

- a first, lower assembly, consisting of a planar running sole intended for sliding, optionally bordered by metallic edges, and of at least one lower longitudinal reinforcement element, the assembly having a plane of symmetry perpendicular to the plane of the running sole on passing through the longitudinal mid-axis of this lower assembly;
- a second, upper assembly constituting the top and the sides;
- finally, an intermediate filling space contained between the first and second assemblies, in which the neutral fiber (FN) is located and which includes another reinforcement element.

For a number of years, skis have been known in which the second, upper assembly assumes the shape of a shell which bears on the two lateral borders of the first, lower assembly.

As is known, a ski is subjected to several types of deformation. During strenuous activity it is mainly subjected to simple normal flexion which is exerted perpendicularly to the running sole on a ski placed flat on its running sole between two supports; this deformation allows it to match the relief of the terrain; the resistance of a ski to this deformation, that is to say its flexional stiffness or alternatively its flexibility distribution, is calculated in order to distribute the load of the skier over the snow.

A ski is also subjected to simple lateral flexion, which is exerted laterally on the side of the ski and causes bending of the longitudinal mid-axis of the lower assembly; this deformation, which is not controlled, is detrimental and impairs precise skiing. Furthermore, a ski undergoes torsion or twisting, especially at its two ends—tip and heel. As before, these deformations are parasitic and hinder correct use of the ski. Finally, a ski is subjected to composite deformations: flexion plus torsion, or alternatively normal flexion plus lateral flexion, etc.

In addition, modern skis essentially have a wide zone in the region of the tip and of the heel and a narrow zone in the region of the support face. Most generally the width of the tip is greater than that of the heel which, in turn, is greater than that of the support face. The crest line joining the tip to the heel, called the "ridge line", is an essential characteristic of a ski. It various from one manufacturer to another, in particular depending on the specific use envisaged. Thus, a slalom ski does not have the same ridge line as a downhill ski, just as that of a leisure ski is different from that of a competition ski.

This ridge line is very important when skiing. It is therefore important that, when being used, it is not altered randomly during deformations of the ski.

As is known, in a beam, the "neutral fiber" (FN) is the zone in which the compressive and tensile stresses cancel. This fictitious zone is defined as a function of the shapes and of the internal composition of the beam. Since a ski behaves as a beam, it consequently has a "neutral fiber", referred to herein below as (FN).

The mechanical reinforcements in a ski are generally located in the intermediate space, actually on either side of the neutral fiber, especially in order to ensure correct mechanical behavior. In order to optimize the efficiency of the reinforcements, it is important to position them as far as possible from the neutral fiber (FN), because it is the square of the distance from the reinforcement to the neutral fiber which is relevant when calculating flexional stiffness.

Most generally, a ski is symmetrical with respect to the plane of symmetry perpendicular to the plane of the running sole and passing through the longitudinal mid-axis thereof.

For a number of years, in order to satisfy technical and esthetic requirements, asymmetric skis have been proposed, that is to say skis whose shape and volume vary in thickness, in length and in width from one side of a given ski to the other, but in which the ridge line nevertheless remains symmetrical. In such skis, in order to conserve simple normal flexion, that is to say without lateral flexion or without parasitic torsion, the manufacturers have been constrained to design an opposed internal reinforced structure correcting the dynamic effects of the asymmetry in shape.

In fact, in order to prevent parasitic lateral flexion arising during normal flexion, it is necessary for the mechanization elements, that is to say the reinforcements, to be placed such that the flexion stiffnesses are symmetrical with respect to the vertical mid-plane passing through the longitudinal mid-axis of the running sole.

Furthermore, in document FR-A-2,611,517, corresponding to document U.S. Pat. No. 5,108,124, a ski has been described which has, against the shell and on each of its two sides, an inclined variable reinforcement which is symmetrical with respect to the mid-plane P of the running sole. When used, this ski behaves as a traditional symmetrical ski.

In document FR-A-2,687,924, the Applicant has suggested inserting, in the intermediate foam-filled space, at least one, optionally asymmetric, openworked tubular reinforcement arranged respectively to the front and to the back of the support face region. This embodiment aims to improve guiding of the ski without stiffening it, in order to make it more comfortable. However, it does not make it possible to ensure optimum transmission of bearing forces on the edges because, as is known, it is in the region of the support face that these bearing forces are most powerful.

In document FR-A-2,589,745, in order to improve strength, it has been proposed to resort to interposed pieces in order to ensure correct distribution of stresses, it being possible for these pieces to form lower or upper corner edges. This theoretical arrangement is difficult to produce, because of the non-negligible risks of detachment of these interposed pieces as a result of shearing induced by the permanent flexion stresses.

In document FR-A-2,590,179, in order to ensure correct transmission of the forces to the inner side of a cross-country ski, it has been proposed to embed, in the intermediate space and in the region of the support face, a ribbed reinforcement in the shape of an inverted U having particular architecture, the side of the long branch of which bears on the inside edge. This arrangement, which is favorable for the practice of skating steps, is not concerned with directing or controlling deformations under bearing forces, because its short length does not extend beyond the support face region, which cannot alter the behavior of the ski.

It can therefore be stated that, in the prior art hitherto known, all skis have been designed in order to avoid generating parasitic lateral flexion during deformation in normal flexion. It can thus be stated that the ridge line, that is to say the respective position of a point on the lower crest with respect to another point located to the front or to the rear thereof, retains its characteristics without modification.

SUMMARY OF THE INVENTION

The invention deviates from this rule in order to demonstrate the advantageous effect of a controlled variation of the ridge line. It relates to a symmetric or asymmetric ski which has the possibility of allowing variation of the ridge line as a function of the thrust given to the skier or as a function of the conditions of use.

This ski, which comprises:

a first, lower assembly, including a planar running sole having a plane of symmetry P perpendicular to the plane of the running sole passing through its longitudinal mid-axis, a second, upper assembly forming a top and sides, these two assemblies defining an intermediate space, in which the neutral fiber (FN) is located and in which, at least in the region of the central support face, a principal longitudinal reinforcement element is arranged which is inclined with respect to the plane of the running sole, is such that the inclined main reinforcement element consists of a flat strip which, while defining an acute angle with respect to the plane of the running sole, is arranged asymmetrically with respect to the mid-plane (P) of symmetry of the lower assembly.

In other words, the invention aims to arrange a flat strip embedded in the constituent for filling the intermediate space, generating, during stresses in simple flexion, an asymmetric deformation with respect to the plane of symmetry passing through the longitudinal mid-axis of the lower assembly (running sole). This strip extends from the first, lower assembly toward the second, upper assembly while defining an acute angle with respect to the plane of the running sole. Being inclined with respect to the plane of the running sole, this flat strip which is an essential feature of the invention induces a lateral component, during stresses, normal to the plane of the running sole.

In the description and in the claims, the term "flat strip" is used to mean a thin bulky strip which is of flattened rectangular cross section so that the deformation is essentially exerted on the two main parallel faces of this strip. In this way, when this inclined strip is embedded in the foam filling, the intermediate space is subjected to a force (or a bearing force) perpendicular to the plane of the lower assembly, it generates, in addition to the usual flexion of the ski, a lateral displacement by decomposition of forces.

The invention is distinguished from the solutions mentioned in the preamble which include reinforcements with symmetrical inclinations and, when they are stressed in deformation under a force normal to the running sole, generate no lateral component, because they are neutralized. It is distinguished from those including reinforcements with different and/or opposed asymmetric inclinations in that the latter counterbalance each other and therefore have no significant lateral component.

In one practical embodiment, the characteristic flat strip extends from the tip to the heel and the inclination of this strip varies regularly from the tip to the heel with respect to the plane of the running sole, respectively from zero degrees in the region of the tip and of the heel, to 45° in the region of the support face.

Advantageously, in practice:

the ski includes a single flat strip intersecting the plane P in the region of its longitudinal mid-axis and defining two equally wide portions arranged on either side of this plane P;

the flat reinforcement strip has constant inclination with respect to the plane of the running sole, close to 45° over part or all of the length of the ski;

the flat strip is made of metal, for example of the sawblade type, or made of a composite sheet-form laminated flat material; it may also be a piece of wood in which the stack of fibers behaves as a laminated assembly.

Although most generally the strip is a single strip, it may also be formed by individual strips which are necessarily parallel, and therefore have the same inclination (see FIGS. 5 and 10) in order to behave as a single strip.

Although, most advantageously, the ski according to the invention is symmetrical, it may also be asymmetrical. Similarly, this ski may be of traditional shape or of more complex shape.

In one embodiment, the inclination of the characteristic flat reinforcement strip is constant with respect to the plane of the running sole, but the width of this reinforcement varies along the ski, together with the height of this ski.

In another embodiment, the ski has a plurality of inclined flat reinforcement strips, with the same angle and same orientation with respect to the plane of the running sole, so that the deformations add together. In fact, if the reinforcements were to be symmetrical with respect to the plane P, cancellation of the lateral effects would result.

When the characteristic strip is arranged in the neutral fiber, no effect is obtained in normal flexion, but an increase in resistance is obtained in lateral flexion. On the other hand, when the characteristic flat reinforcement strip is arranged in the interposed space in proximity to the running sole or at the level of the top, the values both in normal flexion and also in lateral flexion are altered.

The characteristic inclined flat strip may be embedded in the intermediate space forming the core either by in situ injection or by assembly (core made of wood or of rigid polyurethane, or in honeycomb structure). In this embodiment, a core including the characteristic inclined flat strip is made beforehand and the assembly is inserted into the intermediate space in a conventional manner.

The way in which the invention may be embodied and the advantages which result therefrom will emerge better from the following embodiment, in the light of the attached figures.

Figure 2:
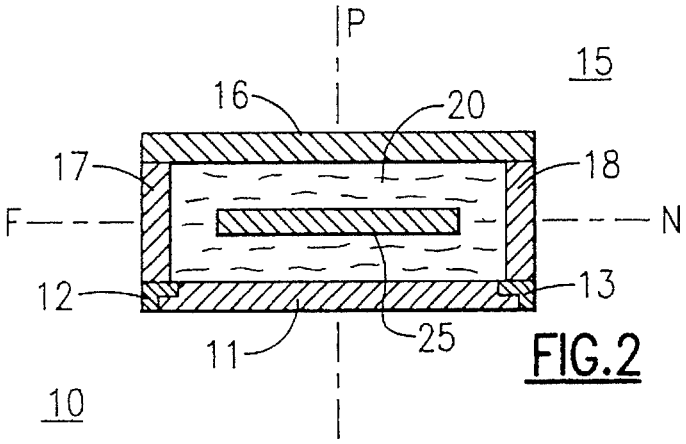
Figure 3:
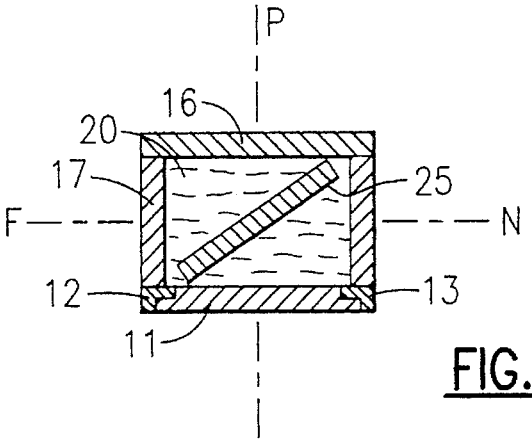
Figure 4:
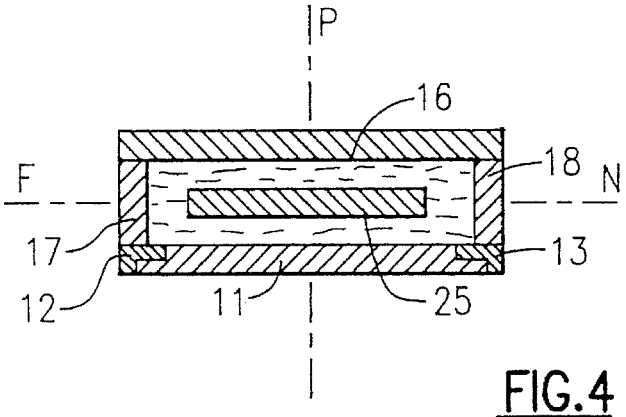

in the region of the tip, in FIG. 2, in the region of the support face, in FIG. 3; and in the region of the heel, in FIG. 4.

Figure 5:
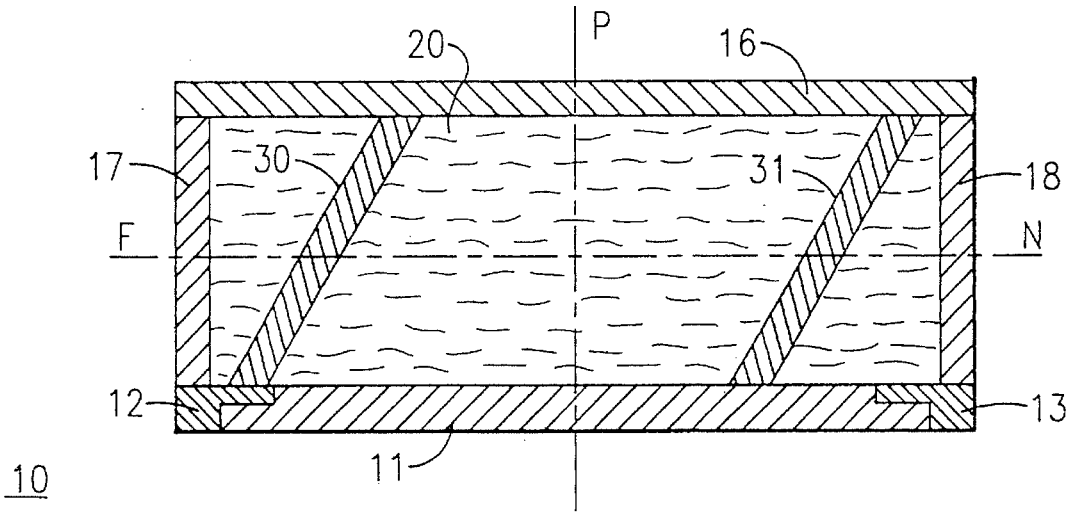
Figure 6:
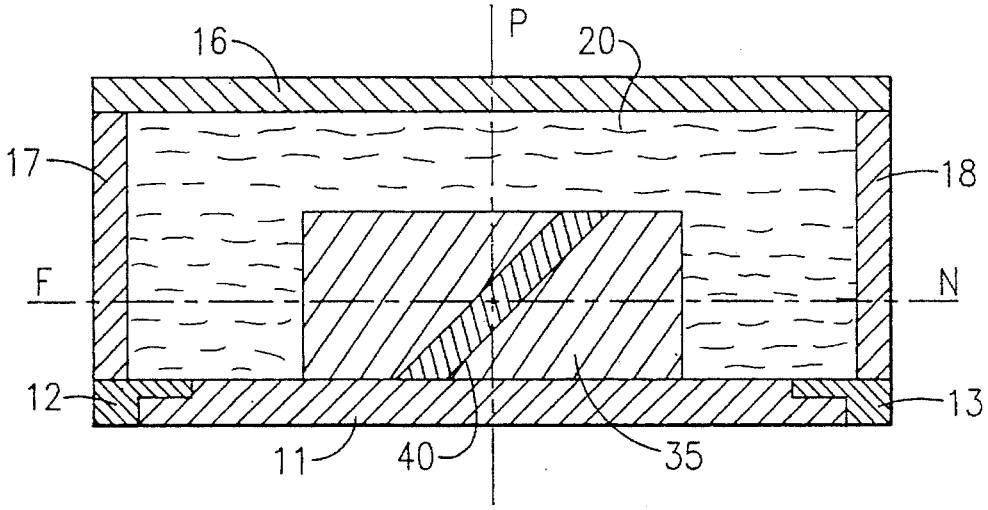

FIGS. 5 and 6 illustrate other embodiments of the invention.

Figure 7:
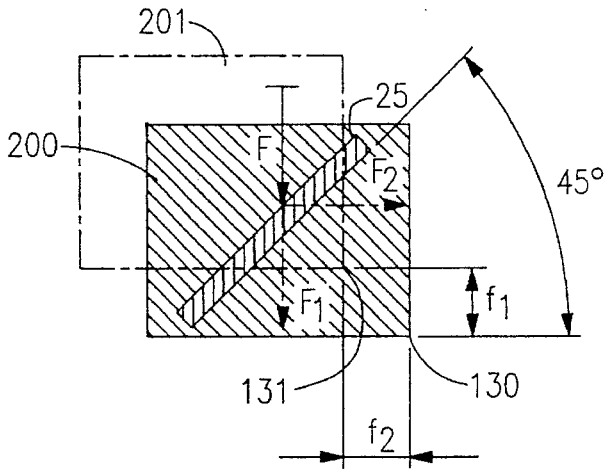
Figure 8:
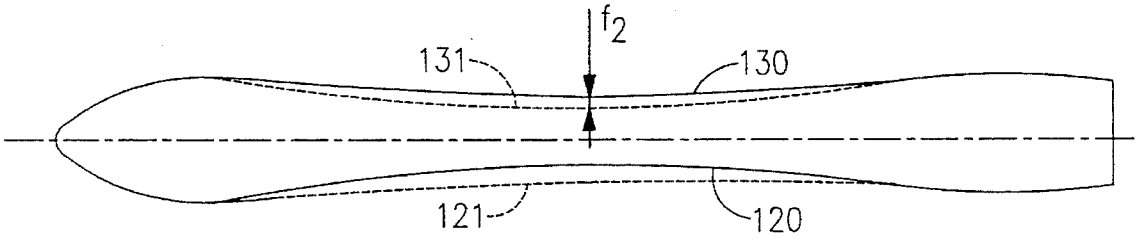

FIGS. 7 and 8 diagrammatically represent the functioning of the invention.

Figure 9:
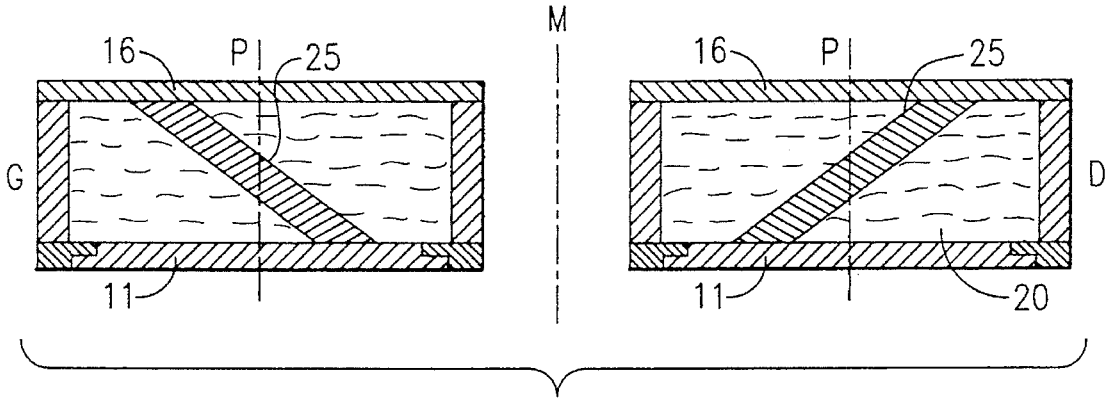

FIG. 9 shows the arrangement of a pair of skis.

Figure 10:
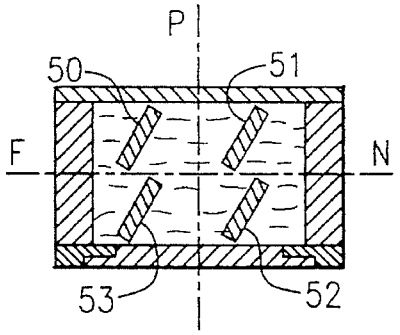
Figure 11:
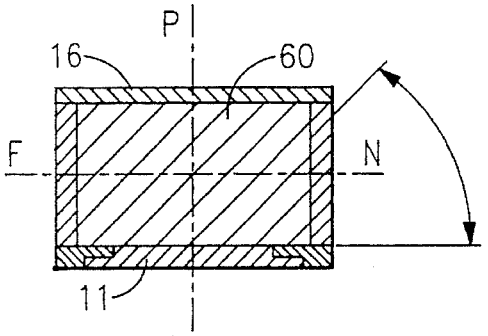
Figure 12:
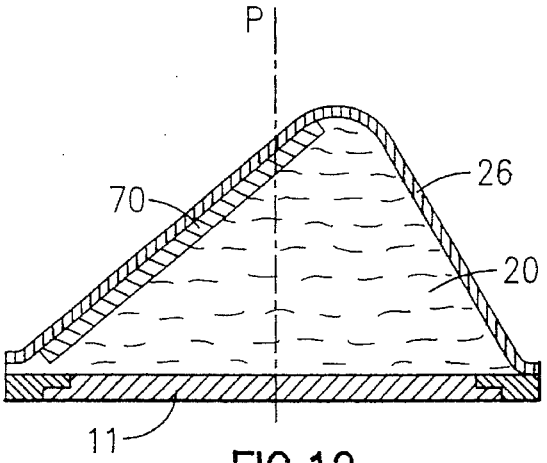

FIGS. 10, 11 and 12 are three other embodiments of the skis according to the invention.

EMBODIMENT(S) OF THE INVENTION

Figure 1:
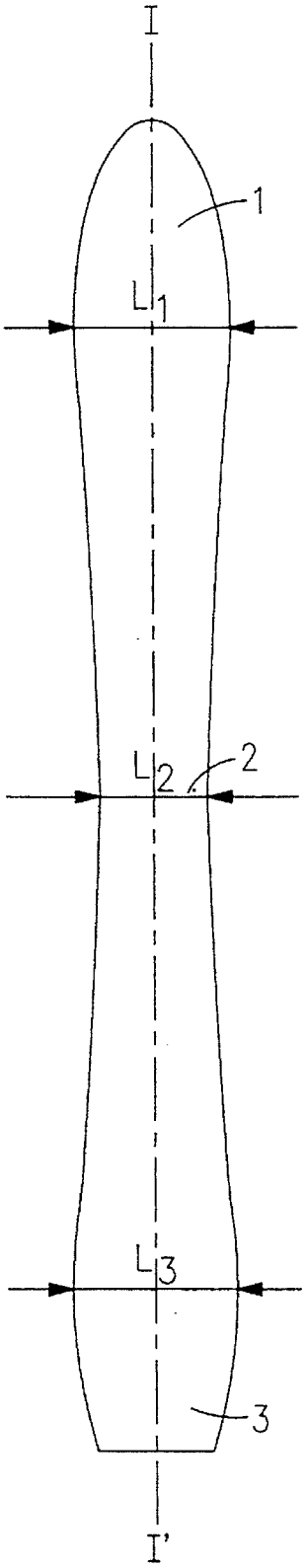
FIG. 1 is a diagrammatic representation, seen from above, of a ski according to the invention, shown in section.

The ski shown in FIG. 1 essentially comprises, in the longitudinal direction, a tip (1), a central support face zone (2) and a heel (3).

In section, according to FIGS. 2 to 4, this ski first comprises a first, lower assembly, denoted by the general reference (10), consisting of a plane running sole (11) bordered on each of its two lateral sides by metallic edges, (12) and (13) respectively. This lower assembly (10) has a plane of symmetry (P) perpendicular to the plane of the running sole (11), passing the longitudinal mid-axis (I–I') of the ski and of the lower assembly (10).

In a known manner, the ski also comprises an upper assembly, denoted by the general reference (15), formed by a top proper (16) and two lateral sides (17, 18) bearing on the edges (12, 13). These two assemblies, respectively lower (10) and upper (15), define an intermediate space (20) defined by the top of the running sole (11), by the inner face of the sides (17, 18) and by the inner face of the top (16).

This intermediate space (20) comprises the neutral fiber diagrammatically represented by the axis (FN), parallel to the plane of the running sole (11). As is known, this neutral fiber (FN) is, at the ends (1) and (3), parallel to the plane of the running sole (11) and it is located substantially equidistant from this plane of the running sole (11) and from the plane of the top (16).

According to one feature of the invention, the intermediate space (20) includes an inclined bulky solid flat reinforcement strip (25) extending from the tip (1) to the heel (3). This flat strip (25) is made, for example, of metal or of fibrous composite material which is commonly applied in the field of skiing. This characteristic reinforcement strip (25) extends practically from the tip (1) to the heel (2) with an inclination which varies regularly with respect to the plane of the running sole (11), namely from zero degrees in the region of the tip (1) and of the heel (3) to 45° in the region of the support face (2). This variation in the inclination of the flat strip (25) is progressive and continuous.

In a practical embodiment, this characteristic flat strip (25) is made of aluminum alloy which is commonly used in skiing and is called ZICRAL (PECHINEY-CEGEDUR registered trade mark) with a length of 120 centimeters, a width of 30 millimeters and a thickness of 0.8 millimeters. In order to allow the injected foam components to pass through, this strip (25) is perforated with a multitude of holes with a diameter of 4 millimeters.

In the region of the support face (2), this characteristic strip (25) (see FIG. 3) extends practically from the inner side of the ski, namely the edge (12), in proximity to the lower assembly (10), to the opposite side of the ski, in proximity to the upper assembly (15).

In a known manner, the intermediate space (20) is filled with a filling material, such as, for example, a polyurethane foam.

According to the configuration of the ski, the width of the characteristic flat reinforcement strip (25) may also vary from the tip (1) to the running face (2) then from this zone to the heel (3). As already stated, it is important for this inclined strip (25) to be bulky and optionally perforated.

In another embodiment, shown in FIG. 5, the foam-filled intermediate space (20) comprises two inclined reinforcements (30) and (31) which are similar to (25), which also vary from 0° to 45°, from the tip or the heel to the support face. Here, these two inclined reinforcements (30, 31) are parallel, extend from the running role (11) to the top (16) while defining an angle of at most 45° with respect to the plane of the running sole, and are arranged asymmetrically with respect to the plane P while intersecting the neutral fiber (FN).

In a third embodiment shown in FIG. 6, the intermediate space (20) comprises a neutral core (35) which is commonly for this application, for example made of wood, in which an inclined reinforcement (40) similar to (25, 30 or 31) is inserted. The rest of the intermediate space (20) is, in a known manner, filled with polyurethane foam. In a variant, this core (35) reinforced by the inclined strip (40) may occupy the entire intermediate space (20).

Theoretical analysis of the functioning of the ski according to the invention:

In the embodiment illustrated in FIG. 1, the maximum width of the ski L1 in the region of the tip is eighty-six millimeters, its maximum width L3 in the region of the heel is eighty millimeters and the minimum width L2 in the region of the support face (2) is sixty-two millimeters.

This ski is placed between two supports each located close to one of the tip (1) and heel (2) ends. FIG. 7 is a diagrammatic representation of this ski (200) in the region of the support face, first shown, in dots and dashes, at rest (201) and next shown under the action of a load F normal to the surface of the running sole, which load corresponds to the weight of the skier. Since the characteristic strip (25) of the invention is inclined by 45°, this load F is converted into two components, respectively a normal component F1 and a lateral component F2. Under the action of these two components F1 and F2, the ski deforms such that the lower crest (131) of the ski (201) at rest will become the crest (130) of the ski (200) under load. This crest (130, 131) will move in normal flexion by a deflection f1 and in lateral flexion by a displacement f2.

On the other hand, if the ski was to include no characteristic inclined reinforcement strip (25), it would, under the effect of the same load F normal to the surface of the running sole, retain a normal deflection which is larger than f1 but would not exhibit the lateral displacement.

FIG. 8 shows, seen from above, the ski according to the invention in two positions, respectively at rest in dots and dashes with its lines of crests (121) and (131), and under load, in solid lines, with its two lines of crests (120) and (130). The lateral displacement f2 is, in this case, similar to an alteration of the ridge line of the ski which, from (121) to (120), will dip even more, whereas on the opposite side (131) and (130), this ridge line tends to become straighter, that is to say flatter. In this way, during skiing, in order to perform a tight turn, the skier will exert on the inside edge a strong thrust F which is decomposed into F1 and F2. This causes an alteration of the ridge line in the region of the support face. If the skis are arranged according to the configuration in FIG. 9, the ski on the outside of the turn, receiving the force F, will have its ridge line dip in the region of the support face. This results in a decrease in the radius of curvature of the turn which is favorable for performing the giant slalom.

As is known, a pair of skis (see FIG. 9) comprises two skis, respectively a left ski denoted by the general reference (G) and a right ski denoted by the reference (D). These skis are symmetrical with respect to a plane M passing between them. According to the invention, the inclined characteristic strips (25) descend from left to right on the left-hand ski G and rise from left to right on the right-hand ski D, so that the directions of the two reinforcement strips (25) intersect on the plane M, below the skis. Thus, when the skier needs to perform wide turns, he or she exerts a minimal load on the skis and he or she traces them in curves resulting from the original ridge line, without substantial alteration. On the other hand, in order to perform tighter turns, the thrust of the skier becomes more forceful, and therefore the load F increases, changing the ridge line which, in this case, will dip more on the inside edge in order to trace tighter curves. The ski according to the invention has thus become interactive, since it adapts according to requirements.

FIG. 10 illustrates a ski according to the invention in which the reinforcement strips (50–53) are inclined by a constant angle and are arranged in pairs on either side of the neutral fiber FN.

FIG. 11 shows another variant of the invention in which it is the entire intermediate space (60) which provides the inclined reinforcement function. This space (60) is occupied by a reinforcement core which is asymmetric with respect to the plane P of symmetry of the lower assembly, that is to say a core in which the fibers forming the reinforcements have an inclination α. This core may be made of wood with its fibers inclined or of bonded laminated wood, so that the sheet-like stack of fibers is inclined by this value α.

FIG. 12 shows a ski of particular shape in which the reinforcement strip (70), which is asymmetric with respect to the plane (P), is bonded against the shell (26), inside the intermediate space (20) filled with polyurethane foam.

I claim:

1. A longitudinally reinforced ski having a tip and a heel, said ski comprising:

a first, lower assembly including a planar running sole having a plane of symmetry P perpendicular to a plane being coplanar with the running sole and passing through a longitudinal mid-axis I–I' of said planar running sole;

a second, upper assembly forming a top and lateral sides;

said first and second assemblies defining an intermediate space, in which a neutral plane (FN) is located and in which, at least in a region of a binding mounting area of the ski, a main longitudinal reinforcement element is arranged which is inclined with respect to said plane of the running sole;

said main longitudinal reinforcement element including a flat reinforcement strip which, while defining an acute angle with respect to said plane of the running sole, is arranged asymmetrically with respect to said plane (P) of symmetry of said lower assembly, said flat reinforcement strip extending from said first, lower assembly toward said second, upper assembly, while intersecting said plane (P) and defining two equally wide portions arranged on either side of said plane (P), said flat reinforcement strip also extending from the tip of the ski to the heel thereof, the inclination of the strip varying progressively and continuously from the tip to the heel, respectively from zero degrees in the region of the tip and in the region of the heel, to 45° in the region of said binding mounting area.

2. The ski as claimed in claim 1, wherein the intermediate space is filled with a plastic foam.

3. The ski as claimed in claim 1, wherein the inclined flat longitudinal reinforcement strip is inserted in a neutral core which is also embedded in the intermediate space.

* * * * *